United States Patent [19]

Thompson et al.

[11] 4,303,041

[45] Dec. 1, 1981

[54] SUPPORTIVE BODY HARNESS

[76] Inventors: William P. Thompson, 6315 Scatterfield Rd., Anderson, Ind. 46011; James M. Stelle, 2904 Fairview St., Anderson, Ind. 46014

[21] Appl. No.: 138,498

[22] Filed: Apr. 9, 1980

[51] Int. Cl.[3] ..... A62B 35/00

[52] U.S. Cl. ..... 119/96; 182/7

[58] Field of Search ..... 119/29, 96; 272/70, 272/70.3; 182/7, 8, 9, 5, 6

[56] References Cited

U.S. PATENT DOCUMENTS

| | | | |
|---|---|---|---|
| 2,500,884 | 3/1950 | Tessin | 182/5 X |
| 2,719,568 | 10/1955 | Webb | 272/70.3 |
| 2,871,915 | 2/1959 | Hogan | 119/29 X |
| 3,761,082 | 9/1973 | Barthel, Jr. | 272/70 |
| 3,780,663 | 12/1973 | Pettit | 272/70 |

*Primary Examiner*—Hugh R. Chamblee

*Attorney, Agent, or Firm*—Robert A. Spray

[57] ABSTRACT

A supportive body harness, having a plurality of straps or strips, with load-sharing and thus high comfort effect by a means which co-ordinate the different support particulars, achieving full and comfortable body-support without any straps passing between the wearer's legs. Particularly useful in conjunction with semi-invalid safety-walker installations which provide for a person's walking support from a supportive trackway mounted on the ceiling.

15 Claims, 5 Drawing Figures

SUPPORTIVE BODY HARNESS

The present invention relates to a supportive body harness, for supporting a human body, particularly useful with a semi-invalid's ceiling-supported safety-walker installation.

Such installations, particularly in view of their nature in having a relatively small but continuous upward pull on the harness, make it desirable that the supportive nature of the body harness be as fully comfortable as reasonably possible.

Accordingly, the concepts of the invention achieve a very comfortable body harness, particularly useful and desirable in connection with associated overhead support means of a ceiling trackway installation or other support from an elevation above the head of the person using the body harness.

The concepts further provide a plurality of interrelated supporting particulars, for distributed support effect, including shoulder support means for supporting the person's shoulders, back supporting means interconnecting the shoulder support means and passing across the person's back, front supporting means also interconnected to the shoulder support means and passing across the chest of person, and a buttocks-support means, all having supporting straps or strips, with a plurality of adjustment features.

More particularly, the concepts provide great comfort by the nature of the load-distributed effect by the several support means which are integrated into an overall support device for a semi-invalid.

A further and even more particular concept provided by the invention is the provision of a plural-effect co-ordinating means, which is connected to forward portions of the shoulder support means, and which keeps the upper portions of supporting strips away from the head of the person using the body harness, and interconnects and interrelates the buttocks-support means to the shoulder support means for achievement of a comfort-enhancing load-sharing or load-spreading as between the shoulder support means and the buttocks-support means, and provides other features of safe operativity.

Still another and important particular achievement of the inventive concepts is the provision that the entirety of the support of the person's body is without any supports or strips passing either around the person's individual legs, or between the person's legs or passing down or up past the person's crotch.

The above is of introductory and thus of somewhat generalized nature. More particular details, concepts, and features, as well as the operativity particulars, and details and advantages of comfort and operativity, are set forth in the more detailed description which follows, reference being had to the accompanying drawings, in which.

Figure 2:
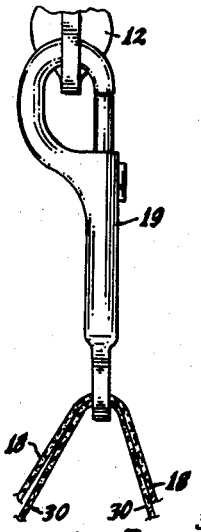
FIG. 2 is an enlarged detail view of a connection, to the uppermost support bar, of the entirety of all the harness components below that support bar.
Figure 1:
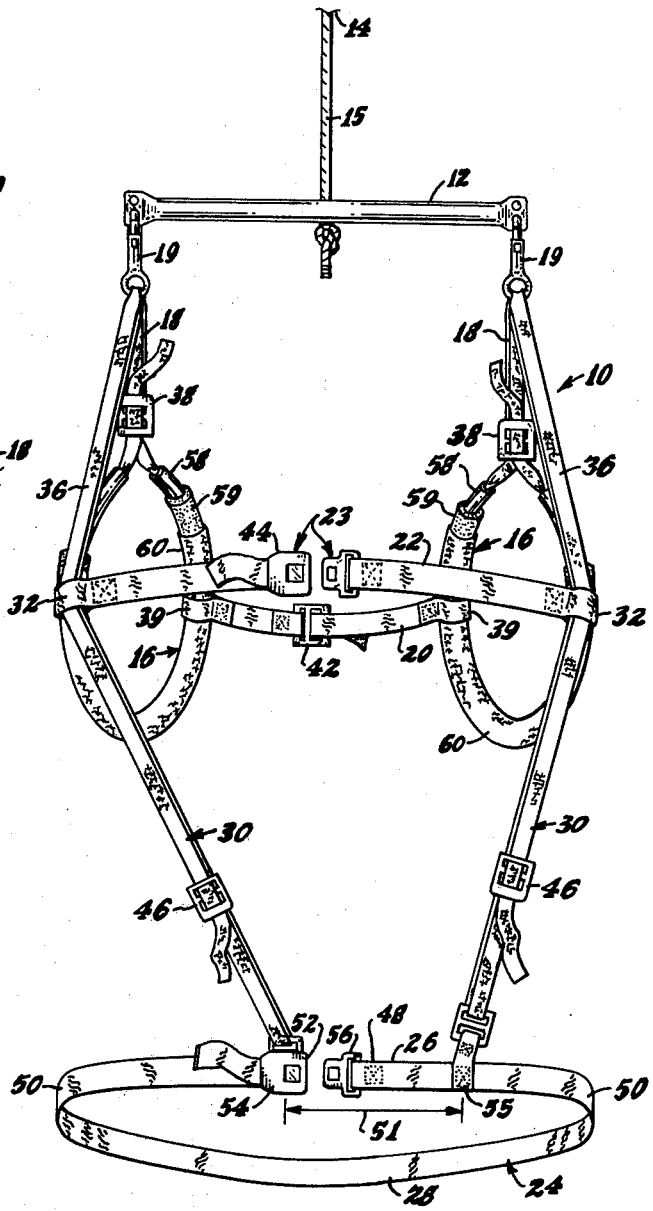
FIG. 1 is a pictorial view of a supportive body harness according to the inventive concepts, this view being in the nature of an elevation view as would be viewed from in front of a person strapped in the harness.
Figure 5:
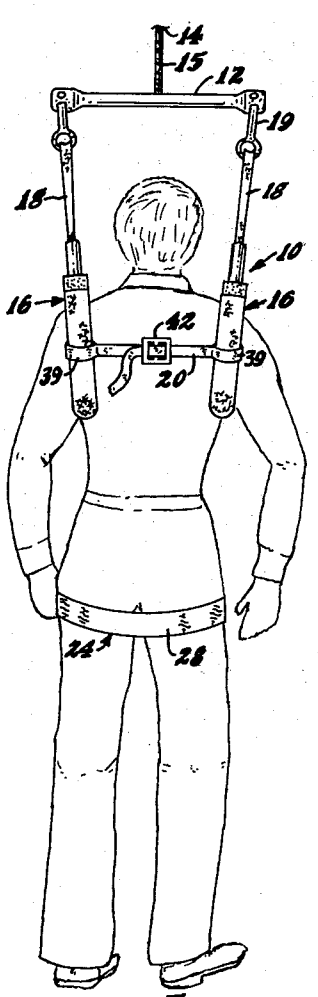
Figure 4:
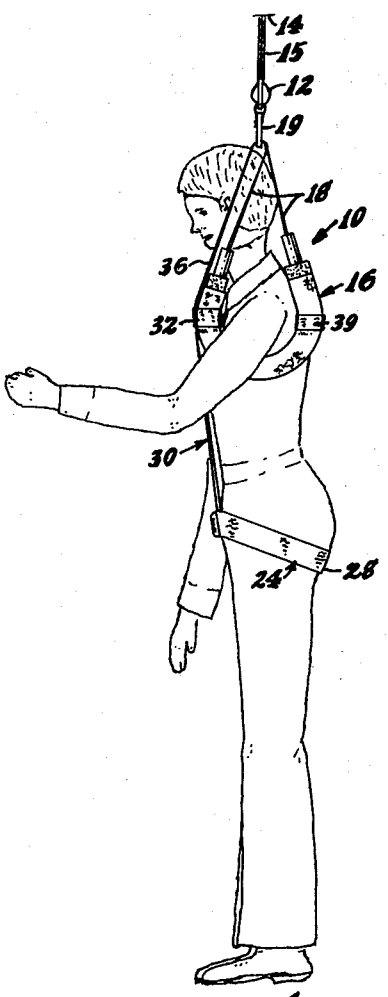
Figure 3:
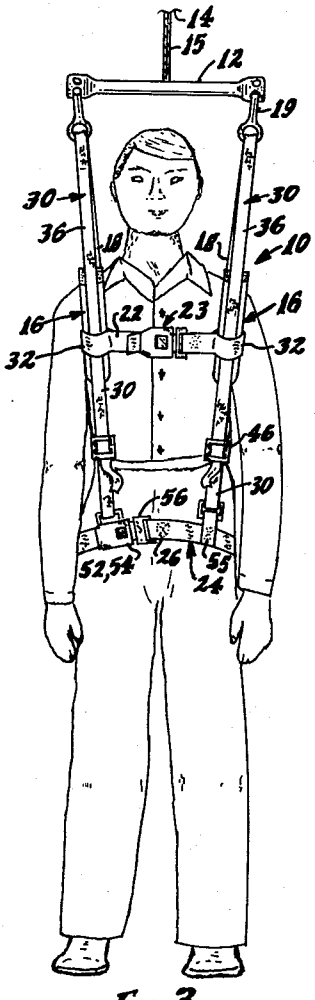

FIGS. 3, 4, and 5 are pictorial views of a person strapped in the supportive body harness of FIG. 1, and more particularly;

FIG. 3 is a view from the front of the wearer;

FIG. 4 is a view from the left side of the wearer; and

FIG. 5 is a view from the back of the wearer.

As shown in the drawings, the concepts of the present invention provide a supportive body harness 10.

More particularly, the supporting harness 10 is such as may be used for supporting a human body in conjunction with a ceiling-mounted trackway installation; and the high amount of comfort achieved by the support the harness 10 provides that it is particularly desirable and advantageous when used with a checked-release means which imparts a continuous upward pull through the body harness.

With such an installation, and because of the many other problems, and even personality characteristics of a semi-invalid, maximum comfort of the body harness is desirable and is here achieved.

The overall device 10 includes an uppermost support means 12, in the form of a horizontal bar, for supporting connection as at 14 of a rope 15 to whatever are the associated overhead support means which are ceiling-mounted or otherwise provide body-support from an elevation above the head of the person using the body harness 10.

The overall body harness 10 provides several interrelated particulars of support; and those, as well as the way they are integrated to give high comfort to the wearer, are now described.

Considering the support particulars from the top down, there are provided shoulder support means 16 for supporting the person's shoulders by passing under the person's armpits; and strips 18 provide support means for operatively supporting the shoulder support means 16 from the uppermost support bar means 12. A connector 19 interconnects the strips 18 to the bar 12.

Also, there is provided a back supporting strip means 20, which operatively interconnects the shoulder support means 16, and it passes across the back of a person using the body harness 10. Further, as shown, there is provided a front supporting strip means 22 which is operatively interconnected to the shoulder support means 16, and it passes across the chest of a person using the body harness 10. The front supporting strip 22 is provided with a coupling 23 (conveniently in the form of a seat belt buckle as for a vehicle) which permits ingress and egress of the person from the harness 10.

Also, the overall harness 10 provides a buttocks-support means 24 which has a forward supporting portion 26 for crossing the front of the person using the body harness 10 in the region of the general front body area above the person's pelvis but below the person's navel. The buttocks-support strip means 24 also has a rearward supporting portion 28 for crossing the rear of the legs of the person using the body harness 10, in the area just below the person's buttocks.

The buttocks-support means 24 is supported by supporting strips 30 which are operatively supportingly connected to the buttocks-support means 24 and by connector 19 to the uppermost support bar means 12.

Particularly desirable and advantageous, the supporting harness 10 also provides co-ordinating support means 32 which are operatively but movably connected to forward portions 34 of the shoulder support means 16. The co-ordinating supports 32, which as shown are advantageously provided as loops at the outer ends of the front supporting strip 22, achieve a plurality of factors. That is, they maintain the upper portions 36 of the long supporting strips 30 (which are supportingly connected to the buttocks-support means 24) spaced laterally outwardly away from the head of the person using the body harness 10. Further, they operatively supportingly interconnect the buttocks-support supporting strips 30 (and thus also the user's buttocks-support means 24) to the shoulder support means 16, thereby achieving a comfort-enhancing load-sharing or load-spreading as between the shoulder support means 16 and the buttocks-support means 24.

The co-ordinating supports 32 further aid safe operativity, by assuring that the buttocks-support supporting strips 30 will always be forwardly of the user's body and that the tensile force in those buttocks-support supporting strips 30 will have an upward component directed forwardly of the user's body; and this, accordingly, better assures that even if the person is in a forward-falling body posture, the increased tensile force in the supporting strips 30 forwardly located with respect to the user's body will be operative to help pull the user's legs upwardly toward a seated position.

Still further, the co-ordinating supports 32 prevent a direct lineal pull in a direction direct toward the uppermost support bar means 12 in the situation of a falling-backward posture, which would tend to act to pull the user's legs so high as to drop the user flat on the user's back.

Much adjustment capability is provided, for maximizing comfort of the wearer. That is, the support strip means 18, which operatively support the shoulder support means 16 from the uppermost support bar means 12, are strips which are adjustable in length, by adjustments 38. Other adjustments are detailed below.

As shown, relative movability of certain of the support strips is provided, which aids in the desired load-sharing effect. One such particular in this respect is that the back supporting means 20 is movably secured to the shoulder support means 16, that being by loops 39 which respectively encircle back portions of the shoulder support rings 16.

Further, the front supporting means 22 (which is operatively interconnected to the shoulder support means 16) is movably secured to the shoulder support means 16.

It will be noted that the front supporting means 22 (which is operatively interconnected to the shoulder support means 16) is connected thereto by the multipurpose loops 32 already mentioned, which operatively receive the buttocks-support supporting strips 30 to provide the operative connection thereof to the shoulder support means 16.

Adjustment details, already mentioned as to adjustments 38 of shoulder-support supporting strips 18, are shown as including an adjustment 42 by which the back supporting strip 20 is made adjustable in length, an adjustment 44 by which the front supporting strip 22 is made adjustable in length, and adjustments 46 by which the buttocks-support supporting strips 30 are made adjustable in length.

The buttocks-support supporting strips 30 are shown connected to the forward supporting portion 26 of the buttocks-support means 24, each at a location intermediate the center 48 and side extremities 50 thereof; and as shown, the interconnections of the buttocks-support means 24 and its supporting strips 30 are located at a spacing 51 of between about four inches and about eight inches.

The buttocks-support means 24 is shown as adjustable, and openable for ingress and egress, by a buckle means 52 having a buckle component 54 which is adjustably fixable to any of optionally-selected portions of the buttocks support means 24, and one of the buttocks-support supporting strips 30 is operatively connected to that buckle component 54, and the other of those strips 30 is connected to a portion 55 several inches away from the end 56 of the buttock's support means 24 which couplingly engages that buckle component 54. (The buckle may be, as shown, in the form of a seat-belt buckle of a vehicle.)

Further comfort is achieved by the shoulder support means 16 being a semi-rigid support member 58, with padding 59 over the semi-rigid support member 58. Desirably, a replaceable outer covering 60 covers the padding 59.

It should be particularly noted that the entirety of the support of the person's body is by the support means and strips set forth above, and without any supports or strips passing either around the person's individual legs, or between his or her legs or passing down and/or up past the person's crotch. This not only provides comfort and avoids chafing, but it also avoids the embarrassing disarray of the wearer's clothing, particularly bothersome or embarrassing if the clothing is a skirt, apron, or robe.

It is thus seen that a supportive body harness, according to the inventive concepts, provides a desired and advantageous device, yielding the high advantages of comfort both during its minimum supporting wearing and when the wearer permits it to sustain much more and even all of the wearer's weight, particularly by the interrelationship of its supportive particulars by which the load is caused to be distributed throughout the various support areas or components.

Accordingly, it will thus be seen from the foregoing description of the invention according to this illustrative embodiment, considered with the accompanying drawings, that the present invention provides new and useful concepts of a supportive harness for a human being such as a semi-invalid, and yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A supportive body harness, such as may be used for supporting a human body in conjunction with a checked-release means having continuous upward pull and thus imparting a continuous upward pull through the body harness, comprising, in combination:

an uppermost support means for supporting connection to associated overhead support means at an elevation above the head of the person using the body harness;

shoulder support means for supporting the person's shoulders by passing under his or her armpits;

support means for operatively supporting the shoulder support means from the uppermost support means;

a back supporting means operatively interconnecting the shoulder support means, and passing across the back of a person using the body harness;

a front supporting means operatively interconnected to the shoulder support means, and passing across the chest of a person using the body harness;

supporting strips operatively supportingly connected to the uppermost support means;

a buttocks-support means having a forward supporting portion crossing the front of the person using the body harness in the general front body area above the person's pelvis but below the person's navel;

the buttocks-support means also having a rearward supporting portion crossing the rear of the legs of the person using the body harness in the area just below the person's buttocks;

the supporting strips being operatively supportingly connected to the buttocks-support means;

the support of the shoulder-support means and the buttocks-support means being from the uppermost support means but in an inter-related manner by co-ordinating means as set forth below;

co-ordinating means operatively but movably connected to both the supporting strips which are connected to the buttocks-support means and to forward portions of the shoulder support means, the co-ordinating means achieving the plurality of factors of (a) maintaining the upper portions of the supporting strips, which are supportingly connected to the buttocks-support means, spaced laterally outwardly away from the head of the person using the body harness, and (b) operatively supportingly interconnecting the said buttocks-support supporting strips and thus also the user's buttocks-support means to the shoulder support means for achievement of a comfort-enhancing load-sharing or load-spreading as between the shoulder support means and the buttocks-support means, and (c) assuring that buttocks-support supporting strips will always be forwardly of the user's body and that tensile force in the buttocks-support supporting strips will have an upward component directed forwardly of the user's body, thus better assuring that even if the person is in a forward-falling body posture the increased tensile force in the supporting strips forwardly located with respect to the user's body will be operative to help pull the user's legs upwardly toward a seated position, and (d) prevents a direct lineal pull in a direction direct toward the uppermost support means in the situation of a falling-backward posture which would tend to act to pull the user's legs so high as to drop the user flat on the user's back.

2. The invention as set forth in claim 1 in which the support means which operatively support the shoulder support means from the uppermost support means are strips which are adjustable in length.

3. The invention as set forth in claim 1 in which the back supporting means is movably secured to the shoulder support means.

4. The invention as set forth in claim 1 in which the back supporting means is a strip which is adjustable in length.

5. The invention as set forth in claim 1 in which the front supporting means is a strip which is adjustable in length.

6. The invention as set forth in claim 1 in which the shoulder support means comprise a semi-rigid support member, padding over the semi-rigid support member, and a replaceable outer covering over said padding.

7. The invention as set forth in claim 1 in which the entirety of the support of the person's body is by such support means and strips and without any supports or strips passing either around the person's individual legs, or between his or her legs or passing down and/or up past the person's crotch.

8. The invention as set forth in claim 1 in which the front supporting means is provided with coupling means which permits convenience of ingress and egress of the person from the body harness.

9. The invention as set forth in claim 1 in which the front supporting means which is operatively interconnected to the shoulder support means is movably secured to the shoulder support means.

10. The invention as set forth in either of claims 1 or 9 in which the front supporting means which is operatively interconnected to the shoulder support means is connected thereto by the co-ordinating means which also operatively receive the buttocks-support supporting strips to provide the operative connection thereof to the shoulder support means.

11. The invention as set forth in claim 10 in which the connection of the said front supporting means to the shoulder support means is by loops which encircle portions of the shoulder support means and which provide the said co-ordinating means.

12. The invention as set forth in claim 1 in which the buttocks-support supporting strips are adjustable in length.

13. The invention as set forth in claim 12 in which the buttocks-support means is made adjustable and openable for ingress and egress, by a buckle means having a buckle component which is adjustably fixable to any of optionally-selected portions of the buttocks-support means; and one of the buttocks-support supporting strips is operatively connected to that buckle component, and the other of those strips is connected to a portion several inches away from the end of the buttock's support means which couplingly engages that buckle component.

14. The invention as set forth in claim 1 in which the buttocks-support supporting strips are connected to the forward supporting portion of the buttocks-support means, each at a location intermediate the center and side extremities thereof.

15. The invention as set forth in claim 14 in which the interconnections of the buttocks-support means and its supporting strips are located at a spacing of between about four inches and about eight inches.

* * * * *